US005340069A

United States Patent [19]

Niemeyer

[11] Patent Number: 5,340,069

[45] Date of Patent: Aug. 23, 1994

[54] BRACKET FOR TRAFFIC CONTROL DEVICE

[75] Inventor: Thomas L. Niemeyer, Woodlands, Tex.

[73] Assignee: Nelok, Inc., The Woodlands, Tex.

[21] Appl. No.: 955,985

[22] Filed: Oct. 2, 1992

[51] Int. Cl.[5] ..... A47B 96/06

[52] U.S. Cl. ..... 248/214; 248/230

[58] Field of Search ..... 248/214, 218.4, 219.3, 248/219.4, 225.31, 230, 231; 403/348, 350

[56] References Cited

U.S. PATENT DOCUMENTS

| | | | |
|---|---|---|---|
| 2,820,655 | 12/1953 | Hileman . | |
| 3,586,280 | 6/1971 | Parduhn | 248/230 |
| 3,764,099 | 10/1973 | Parduhn | 248/214 |
| 3,854,685 | 12/1974 | Parduhn | 248/214 |
| 3,917,205 | 11/1975 | Meadors | 248/231 |
| 4,460,142 | 7/1984 | O'Rorke | 248/231 |
| 4,489,910 | 12/1984 | Ferguson | 248/219.4 |
| 4,659,046 | 4/1987 | Parduhn | 248/231 |
| 4,860,985 | 8/1989 | Olson et al. | 248/229 |
| 4,917,338 | 4/1990 | Olson et al. | 248/229 |

OTHER PUBLICATIONS

Astro-Brac bulletin of VePed Traffic Controls, Inc. Bulletin No. 151 Rev. Aug. 1977.

*Primary Examiner*—Richard K. Seidel

*Assistant Examiner*—Hwei-Siu Payer

*Attorney, Agent, or Firm*—Browning, Bushman, Anderson & Brookhart

[57] ABSTRACT

The present invention is directed to an improved bracket for securing a traffic control device to a mast arm, pole or other support. The bracket comprises a bracket clamp plate and a mast arm anchor plate for engagement, respectively, to the traffic control device and the mast arm. The bracket includes conventional adjustable securing devices for securing the plates to the traffic control device and mast arm. Projecting from each anchor plate are tubular sections sized for telescopic engagement. A tab, either fixed or removable, is included on the inner tubular section for cooperation with an annular shoulder on the interior of the outer tubular section to axially secure the sections together. A fixed tab, if present, is accommodated through a groove or slot in the outer tubular section. A removable tab, e.g., a screw or roll pin, may be inserted and removed into a bore in the inner tubular section through the slot or through a separate aperture in the outer tubular section. The bracket may include a plurality of these tabs, preferably removable and symmetrically disposed about the inner tubular section. Finally, the bracket sections are secured in any desired relative orientation by use of conventional devices, e.g., by clamping in the desired orientation.

23 Claims, 3 Drawing Sheets

FIG. 1
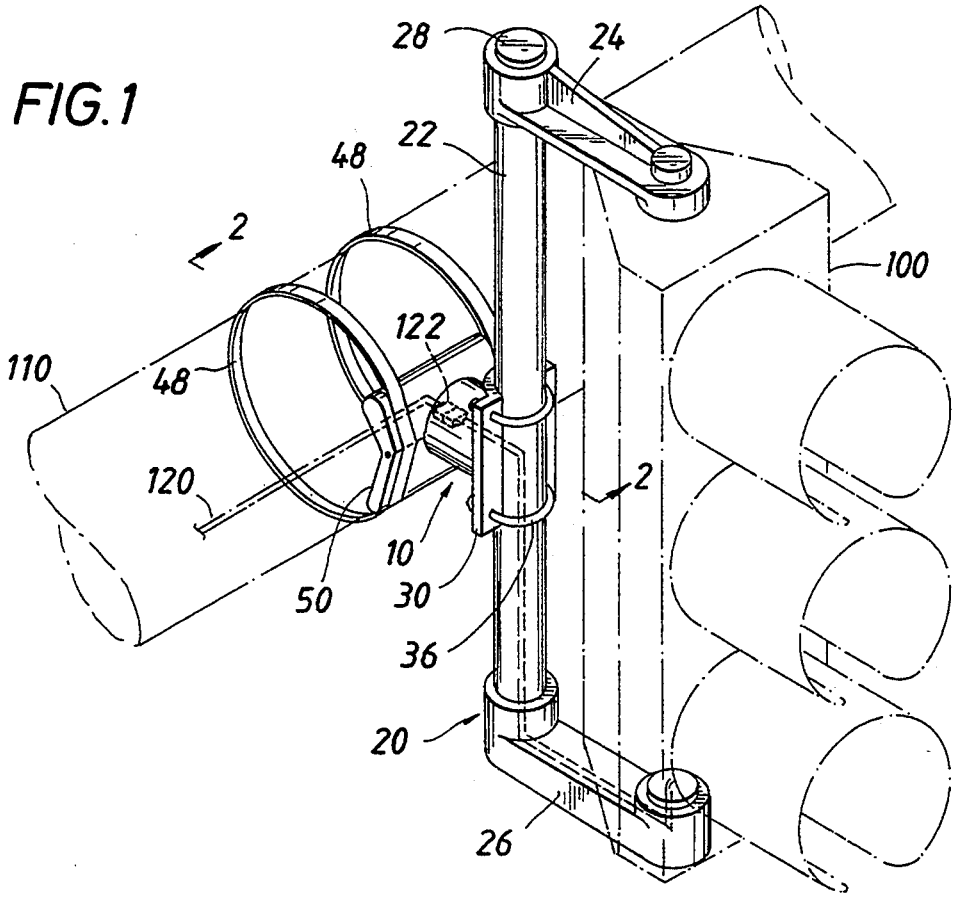
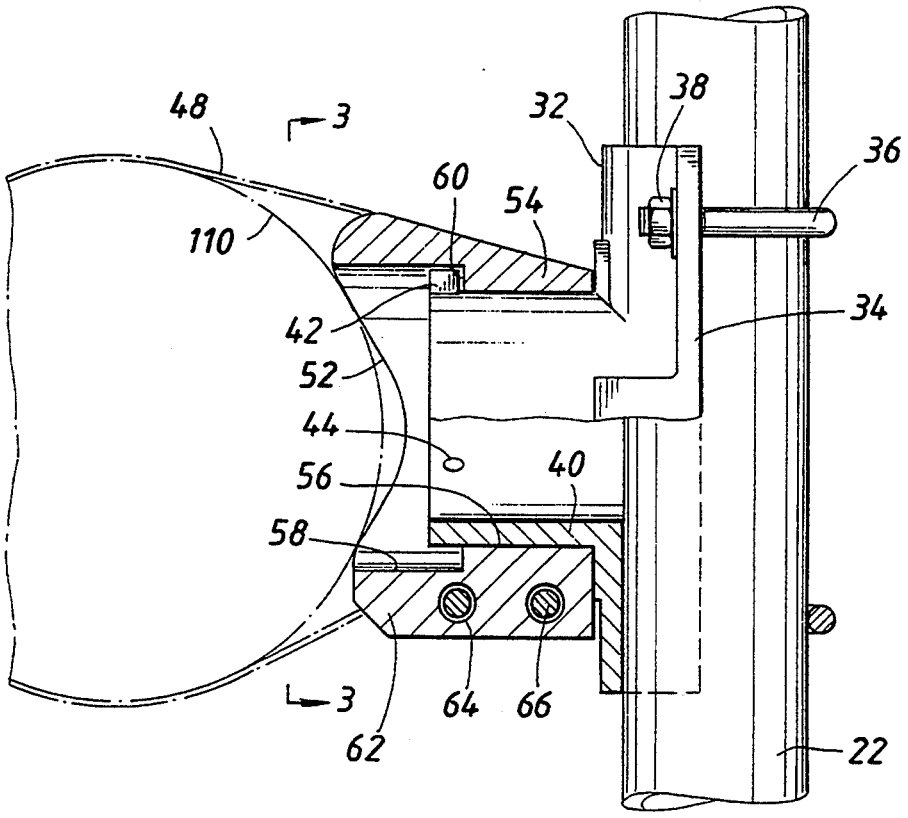
FIG. 2

FIG. 6
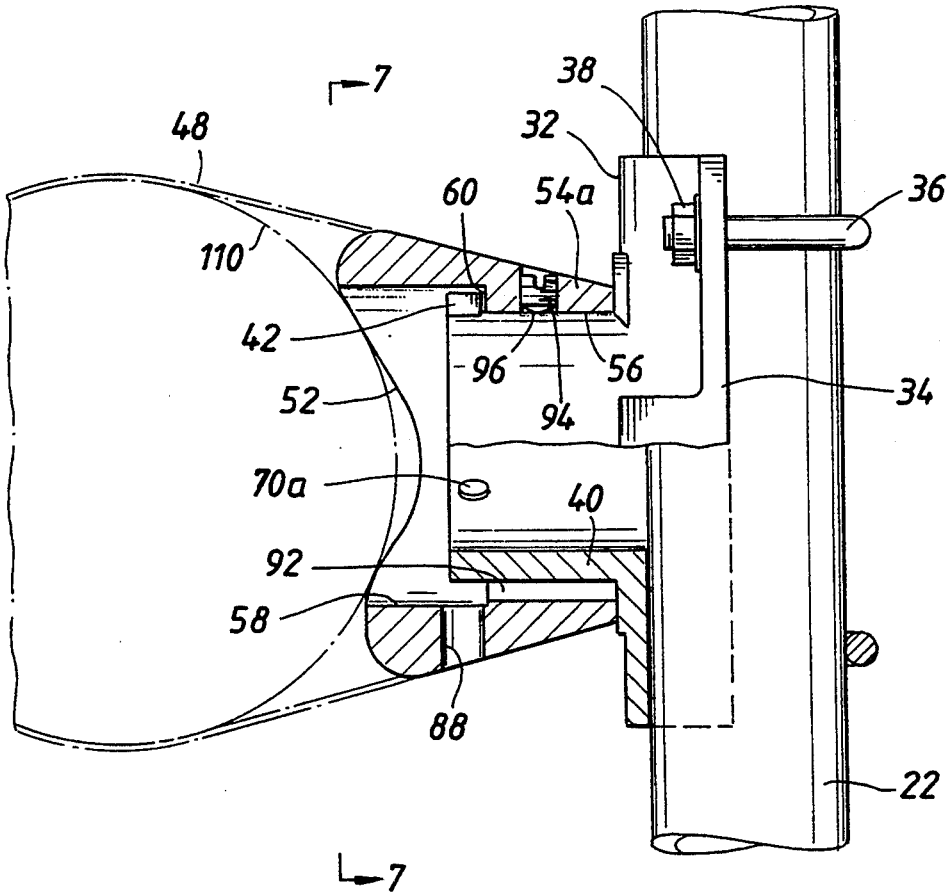
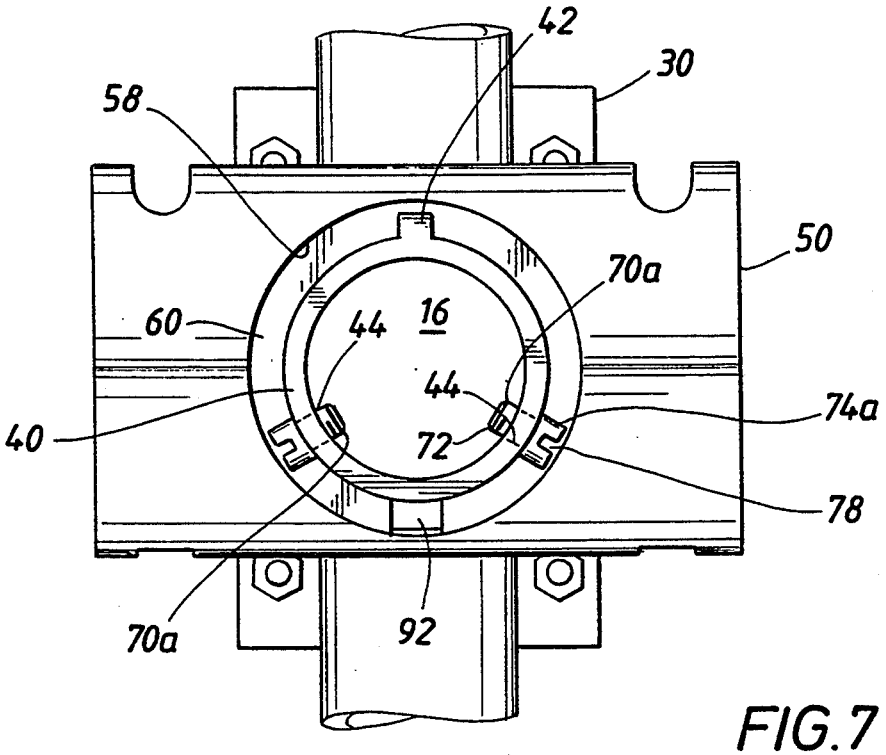
FIG. 7

BRACKET FOR TRAFFIC CONTROL DEVICE

BACKGROUND OF THE INVENTION

1. Field of the Invention

The present invention generally relates to a bracket for securing a traffic control device to a mast arm, pole or other support. More particularly, the present invention is directed to a traffic control device securing bracket comprising a bracket clamp plate and mast arm anchor plate having telescopically engageable tubular sections capable of being axially secured after being placed in telescopic engagement without requiring access from either end of the tubular sections.

2. Description of the Background

Traffic signal lights are typically secured to a horizontally or vertically extending mast arm, pole or other support using a two part bracket. For ease in discussion, the term "mast arm" hereinafter shall refer to any mast arm, pole or other support disposed at any angle. The construction of these securing brackets and the means for adjusting and fixing the orientation of the two parts have developed over the years.

The earliest prior art brackets were simple devices comprising a first clamp for attachment to the traffic control device and a second clamp for attachment to the mast arm. The attached clamps were then screwed, bolted or otherwise fixed together in the desired orientation. U.S. Pat. No. 4,489,910 to Ferguson illustrates a simple bracket of this type capable of securing an electric traffic signal device to a mast arm. Other simple devices of this type are illustrated in U.S. Pat. Nos. 4,860,985 and 4,917,338 to Olson. The devices disclosed by Ferguson and Olson permitted adjustment of the relative orientation of the mast arm and control device bracket portions only through relatively small angles, e.g., about 55 degrees, by use of a conventional slot and screw adjustment means. These simple clamping devices provided no enclosed conduit so that electrical conductors and connections could be aesthetically disposed out of sight within the mast arm, bracket and traffic control device.

An improved bracket was disclosed by Parduhn in U.S. Pat. Nos. 3,586,280 and 3,764,099. See particularly FIG. 2 in each of the Parduhn patents. The bracket disclosed by Parduhn included a first plate designed to engage an elongated member affixed to the traffic control device and a second plate designed to engage the mast arm. Extending from each plate was a tubular section. The tubular sections were sized to permit telescopic engagement. The telescoped tubular sections were threaded together and secured in the desired orientation by engagement of a set screw. The threaded construction disclosed by Parduhn resulted in relatively expensive brackets. Further, in use, the set screw often proved unsatisfactory to maintain the traffic control device in the desired orientation with the mast arm. Exposure to strong winds for long periods of time often resulted in loosening of the set screw which permitted the traffic control signal to rotate from the desired orientation.

While the Parduhn brackets proved unsatisfactory for the foregoing reasons, commercially available brackets similar to those disclosed in Parduhn offered the ability to conceal the electrical wiring within the mast arm, bracket and traffic control device. While the Parduhn patents make no mention of concealed electrical connection, brackets substantially identical to those disclosed in the Parduhn patents, particularly the '099 patent, were sold at least as early as 1977 by VePed Traffic Controls, Inc. of Oklahoma City, Okla. under the trademark Astro Brac. While these brackets permitted the aesthetic concealment of the electrical wiring, the threaded engagement of the telescoping members and use of a set screw to rigidly secure the orientation thereof failed to solve the previously discussed problems associated therewith.

In an attempt to solve the problems resulting from threaded interconnection of the telescopic members and the use of a set screw, an improved bracket was disclosed in U.S. Pat. No. 4,460,142 by O'Rorke. Instead of threaded interconnection of the tubular sections, O'Rorke disclosed the use of a bolt placed along the axes thereof and threaded into the mast arm end plate. While providing a less expensive bracket by eliminating the threaded connection and while providing more secure orientation by eliminating the set screw, the bracket disclosed by O'Rorke failed to make any provision for internal concealment of the electrical conductors and connectors. Further, the bracket disclosed by O'Rorke suffered from the requirement that the relative orientation of the members had to be determined and the bolt tightened before attachment of the traffic signal device to the bracket.

Still another prior art bracket attempting to solve some of the discussed problems was disclosed by Parduhn in U.S. Pat. No. 4,659,046. In the '046 patent Parduhn disclosed a bracket including tubular sections in telescopic engagement. The bracket disclosed by Parduhn in the '046 patent comprised the two basic components for engagement with the mast arm and the traffic control device. The two components included tubular sections telescopically interconnected by use of a snap ring to prevent axial separation. The snap ring was engaged through the opened end of the telescoped tubular sections. The bracket members disclosed in the '046 patent included openings through the bracket plates at the end of each tubular section to permit concealed electrical connections similar to those in the previously discussed Astro Brac bracket sold by VePed. Relative rotation of the telescoped members was permitted prior to rigid interconnection by clamping of the outer section to the inner section.

While the bracket disclosed by Parduhn in the '046 patent solved many of the prior art problems, including the expensive construction associated with threaded interconnection of the telescopic members, mounting failures resulting from loosening of the set screw and concealment of the electrical conductors, other problems remained. For example, because the snap ring had to be inserted through the open face of the mast arm plate, the bracket had to be axially secured before mounting to the mast arm. In fact, the bracket typically was sold with the plates already axially secured by the snap ring. However, in use, installers often would like to secure the individual bracket components to the mast arm and traffic signal device before telescopic engagement of those components. This procedure permits the installer or repairman to quickly install or remove the heavy traffic signal device without having to support is weight for an extended time. Accordingly, the device disclosed in the Parduhn '046 patent failed to solve all of the problems of the prior art.

Because none of the foregoing devices solved all of the problems associated with brackets for traffic control devices and because all suffered from one or more of the aforementioned deficiencies, there has been a long felt but unfulfilled need for an improved bracket for traffic control devices in which telescopically engageable tubular sections assembled to a mast arm and signal device may be quickly and easily connected or disconnected by the installer/repairman, in which the telescopically engaged sections are fully rotatable about 360 degrees and in which the electrical connections may be fully concealed within the telescopically engaged sections. No prior art bracket offers all of the foregoing advantages.

SUMMARY OF THE INVENTION

The present invention is broadly directed to a bracket for securing a traffic control device to a mast arm, pole or other support. The bracket comprises a bracket clamp plate for engagement to an elongated member secured to the traffic control device and a mast arm anchor plate for engagement to the mast arm. Projecting from each anchor plate is a tubular section. The tubular sections are sized to permit telescopic engagement thereof so that one provides an inner tubular section while the other provides an outer tubular section. Also included are means for adjustably securing the clamp plate to the elongated member of the traffic control device and the anchor plate to the mast arm. The bracket includes means for axially securing the tubular sections in telescopic configuration and separate means for rotationally securing the clamp plate and anchor plate to prevent relative rotation about the axes of the telescoped tubular sections.

In its broadest embodiment, the axial securing means is carried on the inner tubular section and engageable and disengageable with the outer tubular section by mere relative rotation thereof. Rotation about a full 360 degrees is permitted. In its preferred embodiment the axial securing means comprises a radially outwardly projecting tab disposed on the distal end of the inner tubular section. The tab is designed for cooperation with an annular shoulder around the interior of the outer tubular section. The outer tubular section includes a passage, preferably a groove or slot, extending between the shoulder and the end of the outer tubular section distal from the anchor plate. While the tab may be a permanent projection, in a presently preferred embodiment the tab is insertable and removable, e.g., a roll pin or screw, through an aperture in the outer tubular section. In an alternative embodiment a plurality of removable tabs, post preferably screws, are symmetrically disposed about the distal end of the inner tubular section. In this most preferred embodiment, all or all but one of the axial securing tabs are removable through the aperture in the outer tubular section.

Because no access through the ends of the tubular section is required, a bracket in accord with any of the designs described herein permits rapid connection and disconnection of the telescoped tubular sections while the bracket plates are secured to the traffic control device and mast arm. The telescoped tubular sections may be rapidly and easily axially secured or released by mere relative rotation thereof. By inserting and engaging through an aperture, e.g., a slot, in the outer tubular section, removable tab, e.g., a screw, into the inner tubular section accidental disconnection of the telescoped sections is prevented.

Brackets in accord with the present invention are inexpensive to manufacture, provide aesthetically pleasing brackets having concealed electrical conductors and connections and are readily assembled/disassembled in the field with minimal effort by the installer/repairman. Brackets in accord with the present invention provide the only brackets in which telescopically engageable tubular sections already assembled to a mast arm and signal device may be quickly and easily connected or disconnected by the installer/repairman, in which the telescopically engaged sections are fully rotatable about 360 degrees and in which the electrical connections may be fully concealed within the telescopically engaged sections. These and other meritorious features and advantages of the present invention will be more fully appreciated from the following detailed description and claims.

BRIEF DESCRIPTION OF THE DRAWINGS

Other features and inventive advantages of the present invention will be more readily apparent by reference to the following detailed description in connection with the accompanying drawings, wherein:

FIG. 1 is an illustration of a bracket in accord of the present invention showing the installed relationship between the bracket, the traffic control device and the mast arm;

FIG. 2 is an illustration taken through the lines 2—2 of FIG. 1 of a bracket in accord with the present invention, in partial cross-section showing the axial and rotational securing means and taken through;

FIG. 6 is an illustration of a bracket in accord with the present invention showing alternative means for axially and rotationally securing the telescoping tubular extensions; and FIG. 7 is an illustration taken through the lines 7—7 of FIG. 6 of a bracket in accord with the present invention showing alternative means for axially and rotationally securing the telescoping tubular sections.

Figure 3:
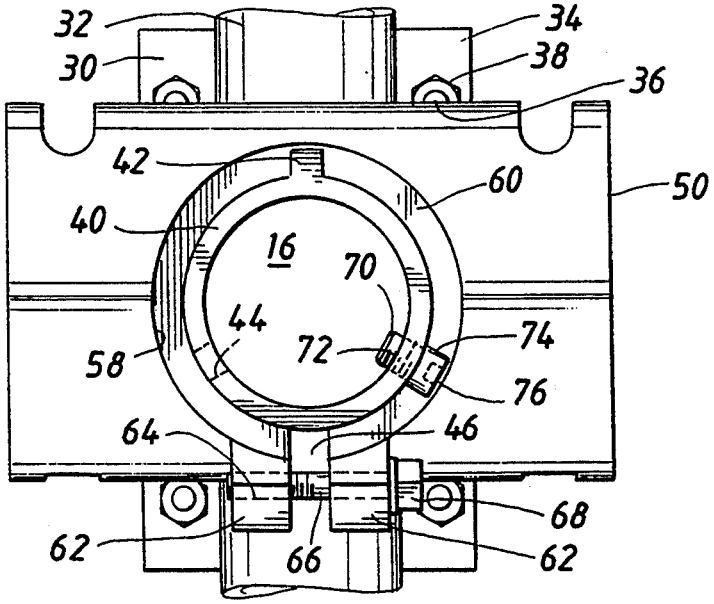
FIG. 3 is an illustration taken through the lines 3—3 of FIG. 2 of a bracket in accord with the present invention as viewed from the open face of the mast arm anchor plate showing a fixed tab and removable screw as axial securing means.

While the invention will be described in connection with the presently preferred embodiment, it will be understood that it is not intended to limit the invention to this embodiment. On the contrary, it is intended to cover all alternatives, modifications and equivalents as may be included in the spirit of the invention as defined in the appended claims.

DETAILED DESCRIPTION OF THE PREFERRED EMBODIMENT

Several brackets in accord with the present invention are illustrated in FIGS. 1-5. In FIG. 1 mounting bracket 10 is shown rigidly secured to vertically disposed traffic control device 100 and to horizontally disposed mast arm 110. Concealed within the bracket 10 mast arm 110 and traffic control device 100 is electrical conductor 120.

The improved mounting bracket 10 of the present invention includes a first major part comprising a bracket clamp plate 30 having a curved face 32 shaped to mate with the side of a traffic control device holding bracket 20 for holding the traffic control device 100. Extending from the opposite face of bracket clamp plate 30 from about an opening 16 through plate 30 is tubular section 40. Bracket clamp plate 30 further includes side flanges 34 on either side of curved face 32. The clamp plate 30 is secured to fixture holding bracket 20 by a pair of U-bolts 36 securing with nuts 38.

Mast arm anchor plate 50 comprises the second major part of mounting bracket 10. Anchor plate 50 has a face 52 shaped to mate with the mast arm 110. Projecting from the other opposite face of anchor plate 50 from about an opening 18 through plate 50 is tubular section 54. Tubular sections 40 and 54 are sized to be telescopically engaged so that in telescopic engagement one tubular section is an inner tubular section and the other tubular section is an outer tubular section. In the illustrated embodiment tubular section 40 is sized to be the inner tubular section while tubular section 54 is sized to be the outer tubular section. However, as those skilled in the art are aware, these tubular sections and the differences therein described below may readily be reversed so that the tubular section carried by the clamp plate 30 could be the outer tubular section while the tubular section carried by the anchor plate 50 could be the inner tubular section. The mast arm anchor plate 50 is secured to mast arm 110 by a pair of adjustable straps 48.

The interior of tubular section 54 comprises a cylindrical bore 56. Bore 56 is further characterized by an annular shoulder 60, preferably formed by counter bore 58 from the end connected to plate 50, for cooperation with the axial securing means disposed on tubular extension 40. Alternatively shoulder 60 could be formed by an annular groove around the interior of tubular extension 54.

The tubular extensions 40 and 54 are telescoped together after tab 42 is aligned with slot 46. The telescoped tubular sections are axially secured by rotation to bring tab 42 out of alignment with slot 46. Axial separation is prevented by cooperation of tab 42 carried on the distal end of tubular section 40 with annular shoulder 60 formed on the interior of tubular section 54 by bore 56 and counterbore 58.

After adjustment of the desired orientation of clamp plate 30 and anchor plate 50, axially secured telescoped tubular sections 40 and 54 are secured in position to prevent rotational movement by any appropriate means. While set screws may be used, the presently preferred and illustrated rotational securing means comprises means for clamping the outer tubular section about the inner tubular section. In the illustrated bracket, tubular section 54 is split lengthwise to form slot 46. See FIG. 3. Flanges 62 project radially outwardly along the side of slot 46. One or more holes 64 are provided in alignment through flanges 62 to receive bolts 66 tightened with nuts 68.

In the embodiment illustrated in FIG. 3, tab 42 is an integral boss extending radially outwardly from the distal end of tubular extension 40. Accordingly, in this embodiment, the outer tubular section 54 must be provided with lengthwise slot 46.

After sections 40 and 54 have been telescoped to the point where tab 42 is beyond shoulder 60, mere relative rotation of the telescoped sections axially secures the two bracket portions. Alternatively, as illustrated in FIGS. 6 and 7, this function may be provided by a lengthwise groove 92 between shoulder **60*a* and the distal end of tubular section 54*a* having sufficient depth to receive a permanent tab 42. Additional stop means, e.g., set screws 70, 70*a* or press fit pins 80, may be inserted through aperture or hole 88 into appropriate bores 44, 44*a*. FIGS. 6 and 7 also illustrate an embodiment wherein telescoped tubular sections 40 and 54*a* are secured against rotational movement by use of a conventional set screw 94 in threaded bore 96 of section 54*a***.

In a presently preferred embodiment, a plurality of stops, preferably three and including tab 42, are symmetrically disposed about the distal end of tubular section 40. Because it is preferred that only a single groove or slot 46 be included, when a plurality of stops are employed, all or all but one of the stops should be removable. When two or more screws 70, or a tab 42 and one or more screws 70, are employed with a single slot 46, the telescopically engaged sections 40 and 54 cannot come apart regardless of their relative orientation. The stops are preferably symmetrically disposed. While the stops have been described as located at the distal end of the inner tubular section, it is only required that they be located away from the clamp plate. While ease of construction would suggest that they be located at or near the end of the tubular extension, they need not be disposed adjacent the end.

FIGS. 2 and 3 illustrate threaded bore 44 through tubular section 40 for receiving therein removable tabs. FIG. 3 illustrates one embodiment of a removable stop comprising screw 70 with thread 72 for threaded engagement with a threaded bore 44. Preferably, screw 70 includes an expanded head 74. Head 74 must be sufficiently small to insert through slot 46 yet should be sufficiently large to prevent screw 70 from being turned completely through tubular extension 40. The depth of shoulder 60 is greater than the height of head 74 to permit free relative rotation of telescopically engaged sections 40 and 54 but is significantly less than the length of screw 70 so that counterbore 58 prevents screw 70 from backing out as long as the screw is not aligned with slot 46.

In FIGS. 4–7 illustrating alternative embodiments, identical parts are identified with the same reference numeral. Similar parts are identified by addition of a letter designation to the basic reference numeral.

Figure 4:
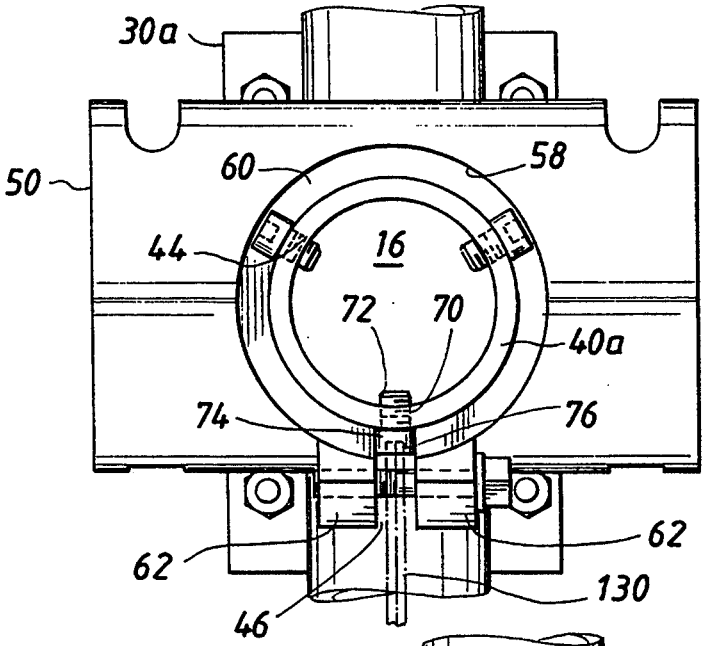
FIG. 4 is an illustration of a bracket in accord with the present invention as viewed from the opened face of the mast arm anchor plate showing a plurality of threaded screws as the axial securing means.

FIG. 4 illustrates an alternative embodiment of the axial securing device wherein the tubular extension **40*a* does not include a permanent tab 42. In the bracket illustrated in FIG. 4, tubular extension 40*a* includes three symmetrically disposed bores threaded 44 for engagement of three allen screws 70. In the embodiment illustrated in FIGS. 3 and 4, screws 70 include allen sets 76 to be driven by allen wrench 130. FIG. 4 illustrates the insertion of one screw 70 into threaded bore 44 through aperture 46**.

Figure 5:
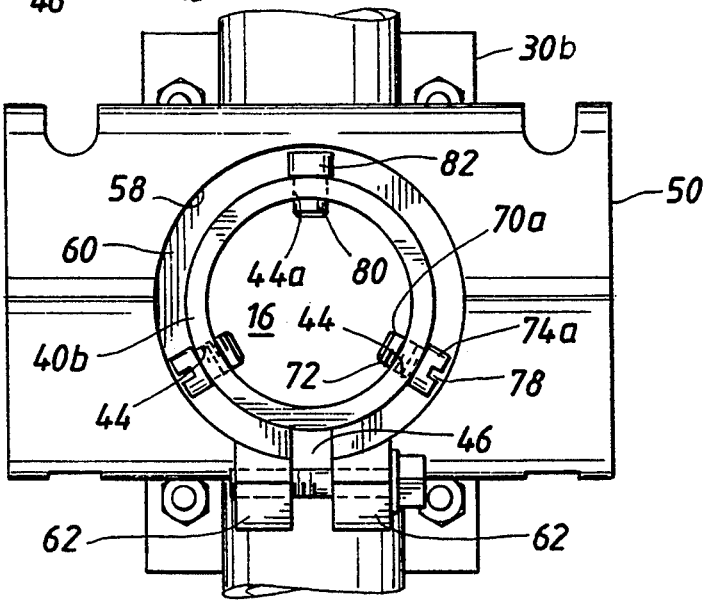
FIG. 5 is an illustration of a bracket in accord with the present invention as viewed from the opened face of the mast arm anchor plate showing a plurality of screws and a press fitted pin as the axial securing means.

FIG. 5 illustrates another alternative embodiment wherein one of the bores in tabular extension **40*b* is not threaded for receipt of a threaded screw. In this embodiment a pin 80, preferably having an expanded head 82, is inserted through slot 46 to be press fit into smooth bore 44*a*. FIG. 5 also illustrates screws 70*a* having conventional straight drive slots 78**.

Fixture holding bracket 20 may be sold as part of the traffic control device 100, as a separate part or even as a part of the improved traffic control bracket of the present invention. Fixture holding bracket 20 comprises an elongated member 22, preferably a tubular section threaded at each end and having an opening along its length for passage of an electrical conductor therethrough. Fixed at the top of elongated member 22 is an upper arm 24 for connection to the traffic control device 100. Fixed at the lower end of elongated member 22 is a lower arm 26 for connection to the lower end of traffic control device 100. Finally, fixture holding bracket 20 includes end caps 28 threaded or press fit in place to seal and protect the interior of elongated member 22.

In addition to providing a readily assembled and disassembled mounting bracket having rapidly engageable axial securing means, the present invention provides an aesthetically pleasing bracket through which all electrical conductors 120 and connections 122 may be concealed. See FIG. 1.

The foregoing description of the invention has been directed in primary part to a particular preferred embodiment in accordance with the requirements of the patent statutes and for purposes of explanation and illustration. It will be apparent, however, to those skilled in the art that many modifications and changes in the specifically described apparatus and methods may be made without departing from the scope and spirit of the invention. In fact, several alternatives have been discussed above. For example, in the illustrated bracket, tubular section 40 on clamp plate 30 is the inner tubular section of the telescoped tubular sections. Alternatively, the inner tubular section could extend from anchor plate 50 with the further features of sections 40 and 54 reversed as required. Other described options include the use of fixed and removable tabs 42 and the use of threaded screw 70 or press fit pin 80 as removable securing devices. In fact, where removable securing devices, e.g., screws 70, are employed, outer tubular section 54 need not include an axial slot 46 but need only include an aperture in alignment with the bores 44 and through which screws 70 may be inserted and removed. When slot 46 is replaced by an aperture, use of a single screw 70 inserted through the aperture will axially secure the telescopically engaged tubular sections 40 and 54 to prevent separation regardless of their relative orientation. Therefore, the invention is not restricted to the particular form of construction and method illustrated and described, but covers all modifications which may fall within the scope of the following claims.

It is Applicant's intention that the following claims cover all modifications and variations which fall within the true spirit and scope of the invention.

What is claimed is:

1. A bracket for securing a traffic control device to a mast arm, comprising:

a bracket clamp plate having one face shaped to mate with a side of an elongated member for holding said traffic control device, having an opposite face with a first tubular section extending therefrom and having an opening therethrough aligned with said first tubular section;

means for adjustably securing said clamp plate to said elongated member;

a mast arm anchor plate having one face shaped to mate with said mast arm, having a second tubular section extending therefrom and sized to be telescoped over said first tubular section of said clamp plate, having an opening therethrough aligned with said second tubular section and having an aperture through said second tubular section;

means for adjustably securing said anchor plate to said mast arm;

means for axially securing said tubular sections together in telescopic configuration while permitting relative rotation about the coincident longitudinal axes of said telescoped tubular sections, comprising an annular shoulder around the interior of said second tubular section, a radial bore through said first tubular section and alignable with said aperture of said second tubular section of said telescoped tubular sections and an axial securing pin insertable into and removable from said bore through said aperture of said second tubular section when said bore and said aperture are aligned for axially securing said telescoped tubular sections by cooperation of said securing pin with said shoulder; and means for rotationally securing said clamp plate and said anchor plate to prevent relative rotation about the axes of said telescoped tubular sections.

2. The bracket of claim 1 comprising a plurality of said bores disposed symmetrically about said first tubular section and a plurality of axial securing pins for insertion therein.

3. The bracket of claim 1 wherein said bore is internally threaded and said pin is externally threaded for cooperation therewith and includes a head which will not pass through said bore.

4. The bracket of claim 1 wherein said means for axially securing further comprises a radially outwardly projecting tab disposed on said first tubular section for cooperation with said shoulder; and passage means for said tab extending along at least the interior of said second tubular section between said shoulder and the end of said second tubular section distal from said anchor plate for permitting telescoping of said tubular sections.

5. The bracket of claim 4 wherein said passage means comprises an axial groove on the interior of said second tubular section.

6. The bracket of claim 4 wherein said passage means comprises an axial slot along said second tubular section.

7. The bracket of claim 6 further comprising securing flanges extending outwardly from said second tubular section along each side of said slot and wherein said means for rotationally securing comprises means for clamping said flanges together.

8. The bracket of claim 1 wherein said means for adjustably securing said clamp plate comprises a plurality of U-bolts sized to extend around said elongated member.

9. The bracket of claim 1 wherein said means for adjustably securing said anchor plate comprises a plurality of flexible straps sized to extend around said mast arm from said anchor plate.

10. The bracket of claim 1 further comprising means for rigidly securing said elongated member to said traffic control device.

11. A bracket for securing a traffic control device to a mast arm, comprising:

a bracket clamp plate having one face shaped to mate with a side of an elongated member for holding said traffic control device, having an opposite face with a tubular section extending therefrom and having an opening therethrough aligned with said tubular section;

means for adjustably securing said clamp plate to said elongated member;

a mast arm anchor plate having one face shaped to mate with said mast arm, having an opposite face with a tubular section extending therefrom and having an opening therethrough aligned with said tubular section of said anchor plate;

said tubular sections sized to be telescopically engaged so that in telescopic engagement one tubular section is an inner tubular section and the other tubular section is an outer tubular section;

means for adjustably securing said anchor plate to said mast arm;

means carried on said tubular sections for axially securing said telescoped tubular sections while permitting unhindered rotation about the coincident longitudinal axes of said telescoped tubular sections, said axial securing means engageable and disengageable by relative rotation of said telescoped tubular sections, said axial securing means comprising a tab means projecting radially from one of said tubular sections for cooperation with an annular shoulder around the other of said tubular sections, said other tubular section further including passage means extending longitudinally along at least the interior of said other tubular section between said shoulder and the end of said other tubular section distal from said one face of said plate from which said other tubular section extends and through which said tab means may pass as said tubular sections are telescoped together; and means for rotationally securing said clamp plate and said anchor plate to prevent relative rotation about said axes of said telescoped tubular sections.

12. The bracket of claim 11 wherein said annular shoulder extends around the interior of said outer tubular section and said passage means extends along at least the interior of said outer tubular section between said shoulder and the end of said outer tubular section distal from its plate for permitting telescoping of said tubular sections; and said tab means projects radially outwardly from said inner tubular section for cooperation with said shoulder, said tab means sized to pass along said passage means as said tubular sections are telescoped together.

13. The bracket of claim 12 wherein said passage means comprises an aperture through said outer tubular section and a plurality of said tab means wherein all but one of said tab means are removable and insertable into a plurality of bores on said inner tubular section through said aperture of said outer tubular section.

14. The bracket of claim 13 wherein all of said tab means are removable and insertable through said aperture of said outer tubular section.

15. A bracket for securing a traffic control device to a mast arm, comprising:

a bracket clamp plate having one face shaped to mate with a side of an elongated member for holding said traffic control device, having an opposite face with a tubular section extending therefrom and having an opening therethrough aligned with said tubular section;

means for adjustably securing said clamp plate to said elongated member;

a mast arm anchor plate having one face shaped to mate with said mast arm, having an opposite face with a tubular section extending therefrom and having an opening therethrough aligned with said tubular section of said anchor plate;

said tubular sections sized to be telescopically engaged so that in telescopic engagement one tubular section is an inner tubular section and the other tubular section is an outer tubular section, said outer tubular section further having an aperture therethrough;

means for adjustably securing said anchor plate to said mast arm;

means for axially securing said telescoped tubular sections while permitting unhindered relative rotation about the coincident longitudinal axes of said telescoped tubular sections, said axial securing means insertable and removable through said aperture of said outer tubular section; and means for rotationally securing said clamp plate and said anchor plate to prevent relative rotation about said axes of said telescoped tubular sections.

16. The bracket of claim 15 wherein said outer tubular section further comprises an annular shoulder around the interior of said outer tubular section;

said inner tubular section further comprises a radial bore through said inner tubular section and alignable with said aperture of said outer tubular section of said telescoped tubular sections; and said axial securing means comprises a device insertable into and removable from said bore through said aperture of said outer tubular section when said bore and said aperture are aligned.

17. The bracket of claim 16 wherein said axial securing device comprises a press fitted roll pin.

18. The bracket of claim 16 wherein said bore is internally threaded and said axial securing device is externally threaded for cooperation therewith.

19. The bracket of claim 16 comprising a plurality of said bores disposed symmetrically about said first tubular section and a plurality of axial securing devices for insertion therein.

20. The bracket of claim 15 wherein said outer tubular section further comprises an annular shoulder around the interior of said outer tubular section and passage means for extending along at least the interior of said outer tubular section between said shoulder and the end of said outer tubular section distal from said anchor plate for permitting telescoping of said tubular sections; and said axial securing means comprises a radially outwardly projecting tab means disposed on said inner tubular section for cooperation with said shoulder.

21. The bracket of claim 20 wherein said passage means extends through said outer tubular section and together with said aperture forms an axial slot.

22. The bracket of claim 21 further comprising securing flanges extending outwardly from said outer tubular section along each side of said slot and wherein said means for rotationally securing comprises means for clamping said flanges together.

23. The bracket of claim 15 where said aperture comprises a hole through said outer tubular section.

* * * * *